US005396218A

United States Patent [19]

Olah

[11] Patent Number: 5,396,218

[45] Date of Patent: Mar. 7, 1995

[54] PORTABLE SECURITY SYSTEM USING COMMUNICATING CARDS

[76] Inventor: George Olah, 2630A Lancaster Road, Ottawa, Ontario, Canada, K1B 5L8

[21] Appl. No.: 95,227

[22] Filed: Jul. 23, 1993

[51] Int. Cl.[6] ..... G08B 13/14

[52] U.S. Cl. ..... 340/572; 340/571; 340/539; 340/573; 340/568

[58] Field of Search ..... 340/571, 572, 573, 539, 340/825.54, 825.44, 825.3, 825.36, 825.52, 825.07, 825.08; 355/100, 38.2; 342/45

[56] References Cited

U.S. PATENT DOCUMENTS

| | | | |
|---|---|---|---|
| 4,593,273 | 6/1986 | Narcisse | 340/571 |
| 4,804,943 | 2/1989 | Soleimani | 340/571 |
| 4,837,568 | 6/1989 | Snaper | 340/825.54 |
| 4,937,581 | 6/1990 | Baldwin et al. | 340/825.54 |
| 5,028,918 | 7/1991 | Giles et al. | 340/825.54 |
| 5,245,317 | 9/1993 | Chidley et al. | 340/571 |

FOREIGN PATENT DOCUMENTS

| | | | |
|---|---|---|---|
| 2301054 | 10/1976 | France | G08B 13/24 |
| 2646944 | 11/1990 | France | G08B 15/02 |
| 4035443 | 5/1992 | Germany | G08B 13/22 |
| 0176339 | 8/1987 | Japan | G08B 21/00 |
| 2132084 | 7/1984 | United Kingdom | G08B 13/18 |
| 2218553 | 11/1989 | United Kingdom | G08B 13/14 |
| 2228814 | 9/1990 | United Kingdom | G08B 13/00 |
| 2236000 | 3/1991 | United Kingdom | G08B 13/00 |

*Primary Examiner*—Edward L. Coles, Sr.
*Assistant Examiner*—Fan Lee
*Attorney, Agent, or Firm*—Philip W. Jones

[57] ABSTRACT

A portable security system is based on maintaining wireless communication between two or more plastic cards within a defined range. In the simplest form, a first card intermittently transmits an identification code to a second card. The second card compares that code with a code in an internal register, and on matching those codes, transmits a return code to the first card. The first card compares the return code with a code in an internal register, and on matching those codes, resets a timer. If the timer is not reset during a defined number of transmissions by the first card, an alarm circuit is activated. One card is attached to a valuable object such as a wallet on the person, and the other card is placed elsewhere on the person; theft of the object from the person results in activation of the alarm circuit. In an advanced form, a master card communicates with a series of slave cards; each of the slave cards is attached to a different valuable object on the person.

30 Claims, 7 Drawing Sheets

PORTABLE SECURITY SYSTEM USING COMMUNICATING CARDS

The invention relates to a security system, and in particular to a portable security system based on maintenance of wireless communication between two or more plastic cards within a defined separation distance.

U.S. Pat. No. 4,908,607, granted on Mar. 13, 1990 to Julian J. Yannotti and Thomas Johnson, discloses an 'Anti-Pickpocket Alarm'. This device involves the attachment of a tether to both a wallet or other valuable object and to an alarm on the person carrying the object such that improper removal of the object from the person actuates the alarm. The alarm system of that patent suffers from the disadvantages of awkwardness and the need to have a tether extending from the valuable object. It would be an advantage if no tether or other type of physical connection were required between the valuable object and the alarm. It would be another advantage if the size of the alarm system could be reduced to a point where the system was virtually invisible to a person using it.

It would not only be desirable to have an alarm that sounded when a valuable object such as a wallet was taken from the owner, but also sounded if such object was inadvertently left behind by the owner. For example, a person in a hurry might inadvertently leave their wallet in their hotel room.

A security system has been developed that utilizes two or more plastic cards in intermittent wireless communication with each other within a defined communication range, and with an alarm on one of the cards adapted to be actuated if such communication is broken. Systems are known that are based on wireless communication between tracking devices, with an alarm sounding if a maximum separation distance is exceeded between those devices. For instance, U.S. Pat. No. 4,973,944 discloses a bracelet which is secured to a convicted felon, and which communicates with a tracking device at a central location. Such systems, however, differ from the subject invention in that the device at the central location is a relatively large piece of equipment.

One intended use of the subject invention is protection of wallets. One of the pair of cards is placed into a wallet carried on the person, and the other card is placed for instance in the person's shirt pocket; the alarm on the latter card is actuated by an attempted pickpocket theft of the wallet. The alarm would also be activated if the person inadvertently forgot the wallet on leaving a hotel room or after using it to make a payment.

In one form, the subject invention comprises a pair of portable cards adapted to be in wireless communication with each other. Each card has a plastic body housing a memory, a carrier signal generator, a modulation means, an antenna, a transmitter, a receiver, a demodulation means, and a comparator means. The memory holds digitized identification data, and the modulation means modulates the carrier signal with the identification data. The transmitter is connected to the antenna for intermittent transmission of the carrier signal to the other card, and the receiver is connected to the antenna for intermittent receiption of a modulated carrier signal from the other card. Each card has a comparator means for comparing identification data in its memory with data carried in the modulated carrier signal received from the other card. A first one of the cards also houses an alarm means. Within a defined communication range, a modulated carrier signal intermittently transmitted by the first card is adapted to create a correspondence in a comparator means housed on the other card and, on finding such correspondence, the other card is adapted to transmit a return modulated carrier signal to the first card. The return modulated carrier signal is adapted to create a correspondence in the comparator means on the first card. An alarm means on the first card is actuated if such correspondence is not created in the comparator means on that card after a defined number of transmissions of the modulated carrier signal by that card.

The other card may be less than 2 millimeters thick. That card may also be less than 60 millimeters high and less than 90 millimeters wide, and may be a credit card or debit card. The modulated carrier signal may be transmitted by the first one of the cards approximately every 0.5 seconds, and the defined number of transmissions may be four.

In another form, the invention comprises a series of portable cards, a first one of the cards being adapted for wireless communication with the other cards. As in the foregoing form of the invention, in this form each plastic card houses a memory, a carrier signal generator, a modulation means, an antenna, a transmitter and receiver, a demodulation means, and a comparator means. The first card also houses an alarm means. Within the defined communication range a modulated carrier signal intermittently transmitted by the first card is adapted to create a correspondence in a comparator means on each of the other cards. On creation of a correspondence on each of the other cards, that card is adapted to transmit a return modulated carrier signal to the first card. Each return modulated carrier signal is adapted to create a correspondence in the comparator means on the first card. An alarm means on the first card is actuated if such correspondence is not created in the comparator means on that card by each of the return modulated carrier signals after a defined number of transmissions of the modulated carrier signal by that card.

A still further form of the invention also has a first card and a series of other cards, but each other card has an activation switch and is unable to communicate with the first card until that switch is activated. The first card is made aware of which other cards have been activated. In this form of the invention, communication only occurs between the first card and those other cards that have been activated. An alarm means on the first card is actuated if a correspondence is not created in the comparator means on that card by each of the return modulated carrier signals from the activated other cards after a defined number of transmissions of the modulated carrier signal by the first card.

One of the other cards may be less than 2 millimeters thick. That card may also be less than 60 millimeters high and less than 90 millimeters wide, and may be a credit card or debit card. The modulated carrier signal may be transmitted by the first one of the cards approximately every 0.1 seconds, and the defined number of transmissions may be four.

All forms of the portable security system may use a microprocessor to perform the functions of the memory, the modulation means, the demodulation means and the comparator means. Also, all forms of the security system may have a defined communication range of approximately three meters, use a carrier signal frequency of 134 kilohertz, and have a memory that holds 32 bits of identification data. The 32 bits is sufficient to allow differentiation between a large number of cards (in the tens of millions).

The invention will next be described by means of preferred embodiments utilizing the accompanying drawings, in which.

Figure 1:
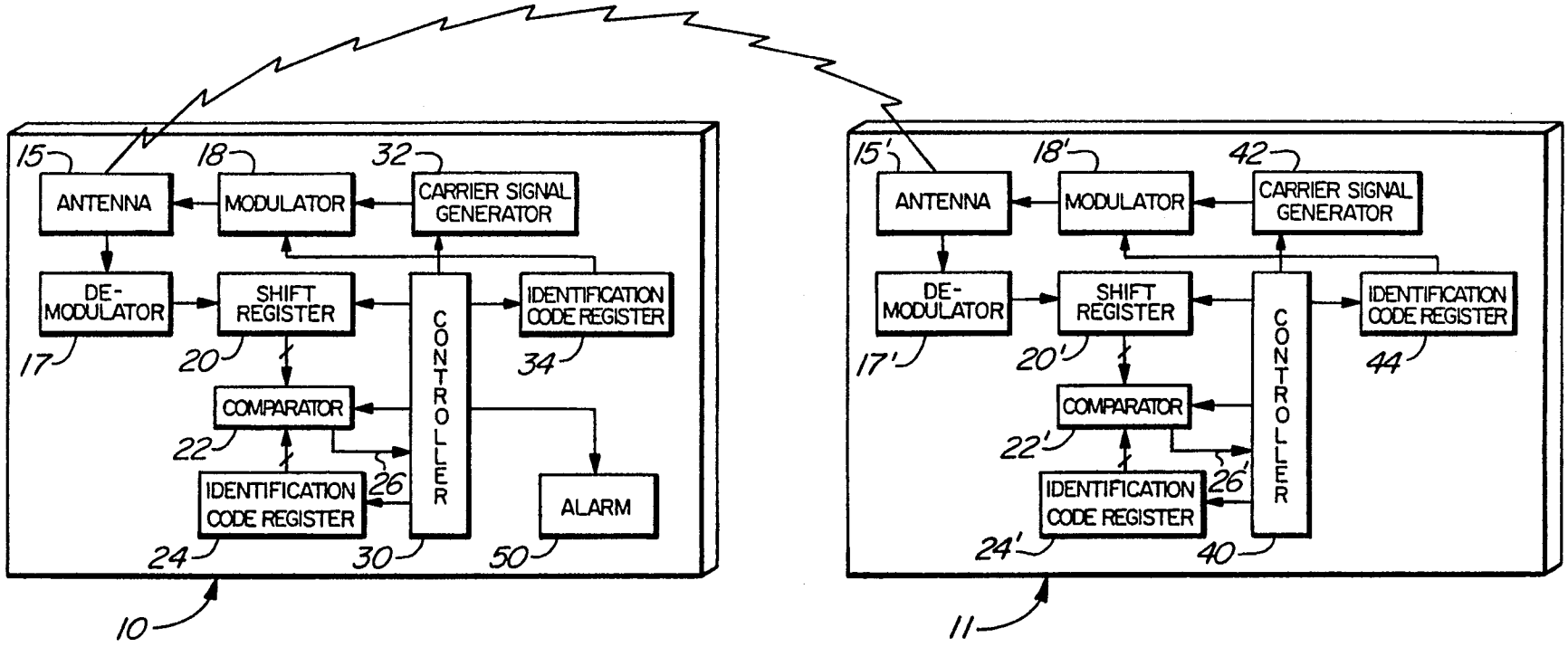
FIG. 1 illustrates two plastic cards with embedded circuitry in a first preferred embodiment of the invention.

With reference to FIG. 1, two thin plastic cards that are generally designated 10 and 11, are each less than 2 millimeters thick. Each may in fact be sized to conform with ISO Standard 7810, which defines the size of commercial credit cards and debit cards. Under that standard, a card has a nominal thickness of 0.76 mm., a nominal height of 53.98 mm. and a nominal width of 85.60 mm. On the card 10 is mounted an antenna 15 that acts on both the reception and transmission of a radio frequency (RF) carrier signal. In this embodiment, a frequency of 134 kilohertz is selected for the carrier signal. The antenna 15 is connected to a signal demodulator 17, and to a signal modulator 18. Signal demodulator 17 removes a 32-bit digital identification code carried at 9600 bits/second from the carrier signal, and that code is shifted serially into a shift register 20. Once register 20 has been loaded, its 32-bit contents are compared in a comparator 22 with the contents of a 32-bit identification code register 24. If the contents of register 20 matches the contents of register 24, comparator 22 produces a code match signal on output line 26. Card 11 has similar components; each has been designated with the same number as on card 10, but with a prime (') added. The differences between the two cards will next be discussed.

Card 10 initiates the intermittent communication between the two cards. Approximately twice per second, a controller 30 on card 10 turns on a carrier signal generator 32 connected to modulator 18. After the carrier signal has stabilized, the contents of identification code register 34 are fed onto the carrier signal at 9600 bits/-second by modulator 18. A controller 40 on card 11 continuously monitors demodulator 17' for any sign of a carrier signal, and on sensing the commencement of such signal the controller 40 prepares shift register 20' to receive an identification code from demodulator 17'. Once shift register 20' has been loaded serially, its 32-bit contents are compared in comparator 22' with identification code register 24'. If the two 32-bit inputs to comparator 22' match, the output line 26' changes state. That change in state causes controller 40 to turn on carrier signal generator 42 connected to modulator 18'. After the carrier signal has stabilized, the contents of an identification code register 44 are fed onto the carrier signal at 9600 bits/second at modulator 18'.

Meanwhile, controller 30 on card 10 has turned off carrier signal generator 32 and has started monitoring demodulator 17 for any sign of a return carrier signal from card 11. On sensing the commencement of that return carrier signal, controller 30 prepares shift register 20 to receive an identification code from demodulator 17. The shift register 20 is then loaded serially, and its output compared in parallel with the identification code register 24 on card 10 by comparator 22 on that card. If output line 26 changes state, indicating a match, controller 30 restarts an internal timer. If that timer is not restarted within approximately 2.25 seconds, controller 30 sets an alarm register which activates a piezoelectric alarm circuit 50 housed within card 10.

Figure 2:
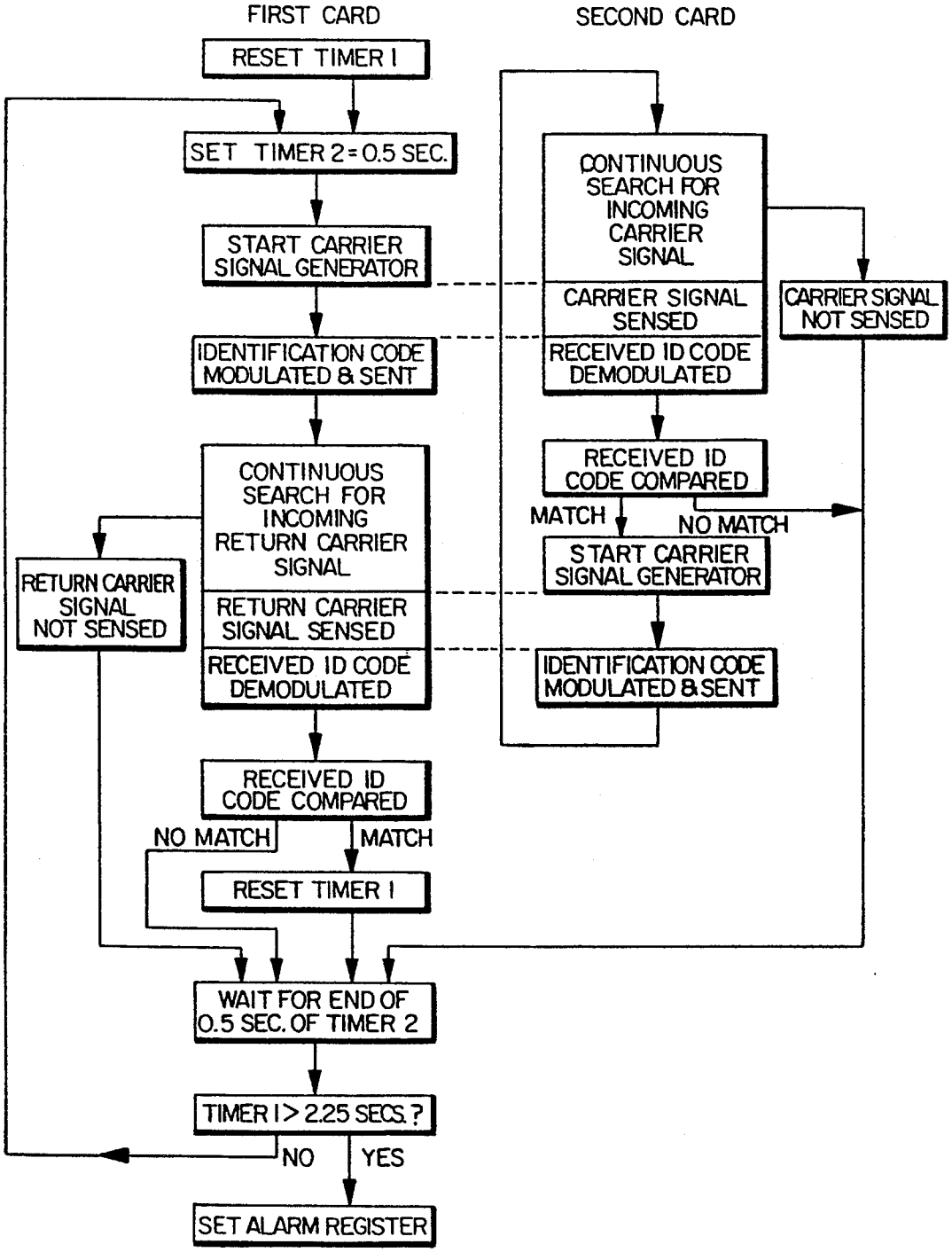
FIG. 2 is a block diagram of the routines embedded in the two cards of FIG. 1.

FIG. 2 is a block diagram of the routines embedded on cards 10 and 11, illustrating the communication interfacing between the two cards.

If cards 10 and 11 have the same identification code, register 23 may be replaced by register 24 on card 10 and register 44 may be replaced by register 24' on card 11. The communication range between cards 10 and 11 is a function of several variables, including the carrier signal frequency and the antenna design. Regarding the latter, antennae 15 and 15' are each selected to be a loop-shaped antenna with a diameter of approximately 2.0 cm. The loop is formed from a wire that has 20 helical turns, each approximately 0.5 mm. in diameter. As mentioned earlier, the carrier signal frequency is 134 kilohertz, although a large range of other frequencies might be used.

The block elements shown on cards 10 and 11 in FIG. 1, with the exception of antennae 15 and 15' and alarm circuit 50, are created as a microchip. The microchips for cards 10 and 11 differ only in the program on the respective controllers 30 and 40. Each microchip is created with a set of external leads for an antenna (15 or 15'), alarm circuit 50, and a battery power supply. The appropriately-programmed microchip, with connected antenna, alarm circuit (card 10 only), and battery, is then embedded in plastic.

Figure 3:
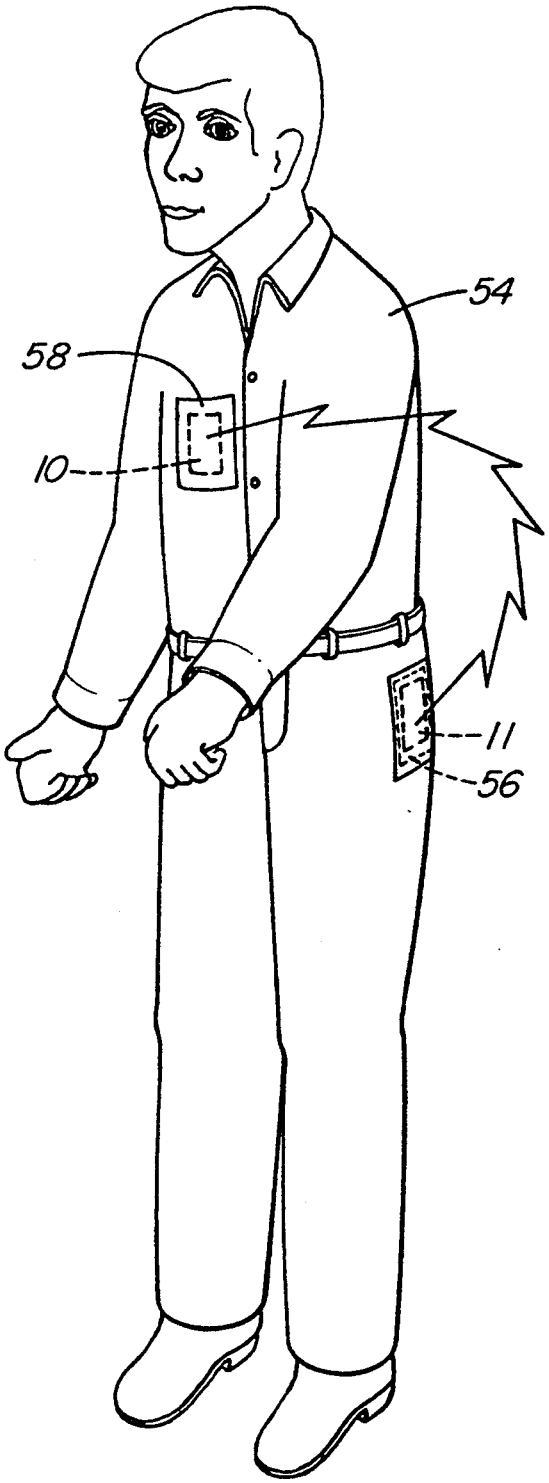
FIG. 3 illustrates the placement on a person of the two plastic cards of FIG. 1.

FIG. 3 illustrates the possible placement of the cards 10 and 11 on a man 54. Card 11 is put into a wallet 56 next to the man's credit cards. Card 10 is placed into the man's shirt pocket 58. Theft of the wallet breaks the communication between cards 10 and 11, and the alarm circuit 50 on card 10 is activated. The power supply on each of the cards 10 and 11 lasts approximately three years, and the alarm circuit 50 on card 10 is activated when the voltage level on either power supply drops below its operative range. Card 11 communicates its low voltage condition to card 10 by altering the state of a bit that is transmitted to card 10 with each identification code transmission.

The identification code programmed into card 10 may be the same as the identification code that is programmed into card 11, or those two codes may be different. It is necessary, however, that at its production each card is told of the identification code on the other card.

Figure 4:
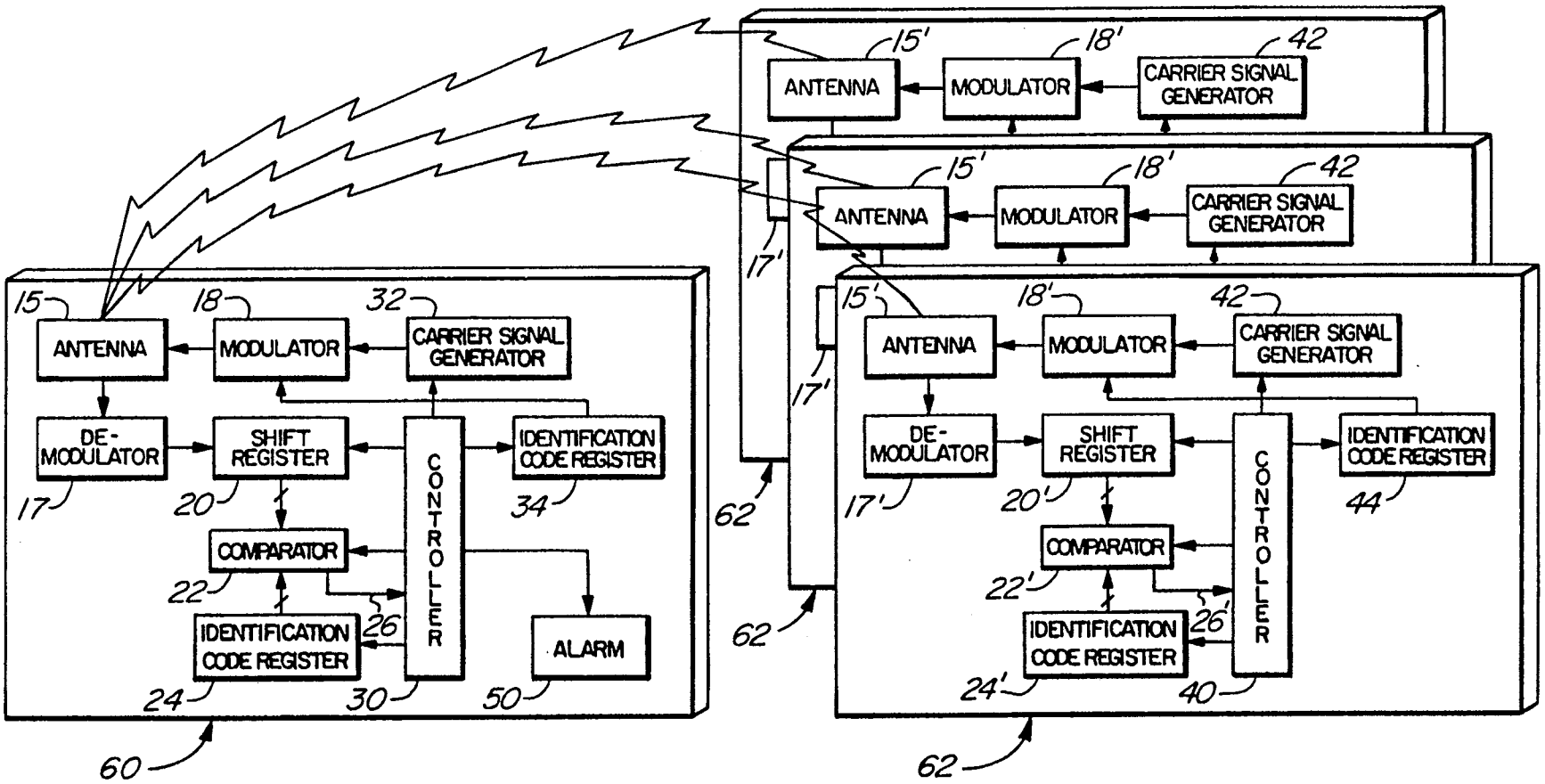
FIG. 4 illustrates a master card and three slave cards of a second preferred embodiment.

A second preferred embodiment of the invention is illustrated in FIG. 4. In this embodiment, a 'master' card 60 and a series of 'slave' cards 62 intermittently communicate in an analogous manner to the two cards 10 and 11 described above. The block diagram of the program embedded on card 62 is similar to the program shown under 'second card' in FIG. 2. The program embedded on card 60 varies from that shown under 'first card' in FIG. 2, in that card 60 sequentially runs a similar routine for each slave card. In master card 60, TIMER2 is set to 0.1 seconds, TIMER1 is set to 0.45 seconds, and path 'A:ONE SLAVE CARD ONLY' in FIG. 2 is replaced by the path 'B:MORE THAN ONE SLAVE CARD'. The three identification code values used by identification code register 24 are taken from a storage space in the program code. As with the first embodiment, with this embodiment it is necessary for the master card at its production to be programmed with the identification code of each of the slave cards with which it will communicate. It is also necessary for each slave card at its production to be loaded with the identification code of the master card.

Figure 5:
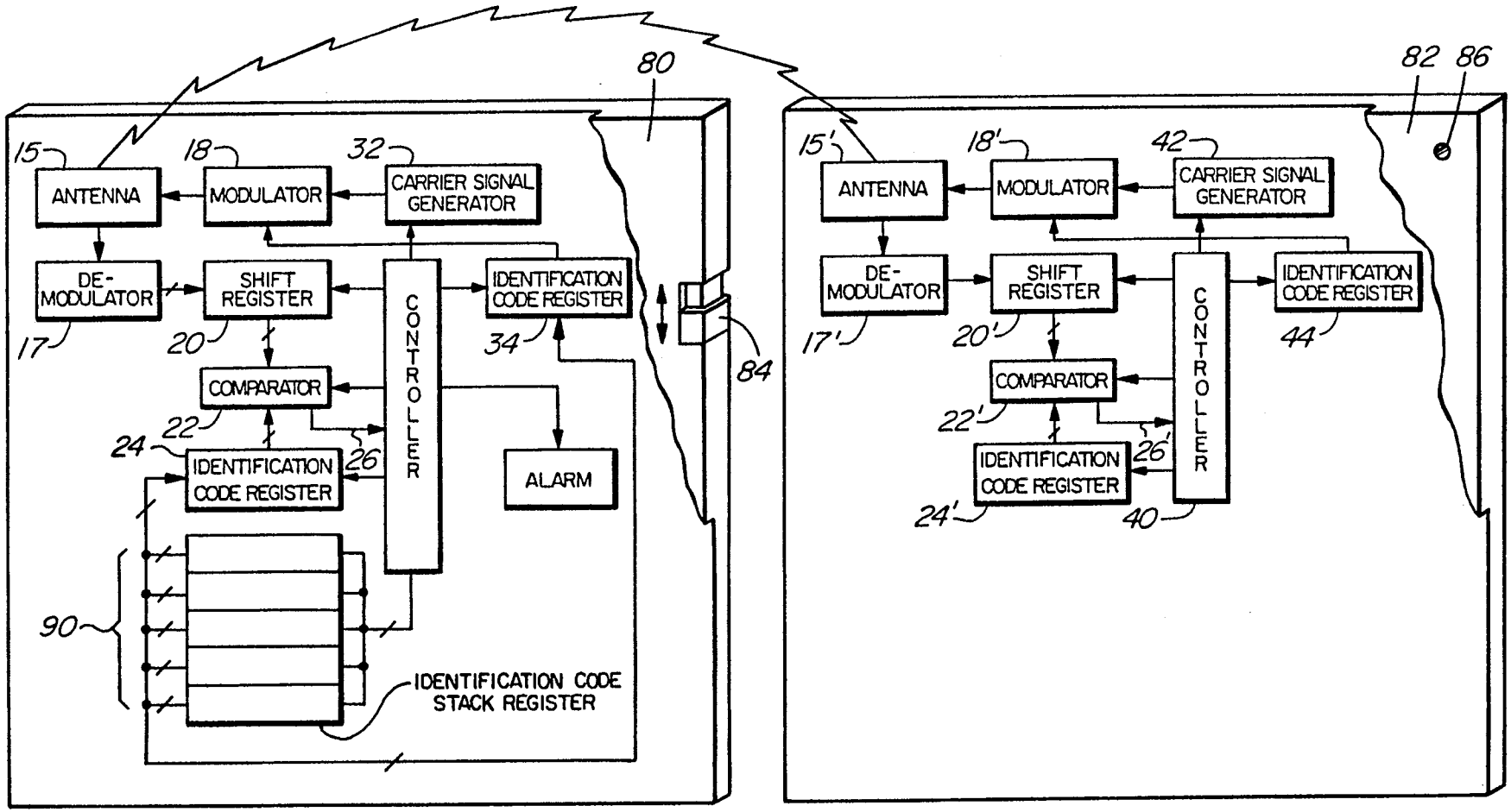
FIG. 5 illustrates a master card and a slave card of the third preferred embodiment.

A third embodiment has a master card 80 in communication with a series of slave cards 82 similar to the second embodiment, but additionally has a reset switch 84 on the master card and a pinhole switch 86 on each slave card, as shown in FIG. 5. Unlike master card 60 of the second embodiment, the identification codes of slave cards 82 are not programmed into master card 80 at production. Instead, master card 80 incorporates a short 34-bit stack register 90 to store the identification codes of slave cards 82 that are within its communication range when reset switch 84 is pressed. The advantage of such an arrangement is that the number of slave cards 82 which are communicating with the master card 80 can be varied, and those slave cards need not have been produced at the same time as the master card. Of the 34 bits comprising each entry in stack register 90, 32 bits are used for the identification code, 1 bit is used as an activity bit to indicate if the slave card associated with that identification code is active, and 1 bit is used for battery level to indicate if the slave card associated with that identification code has a low battery.

The pinhole switch 86 on each slave card 82 results in battery power being conserved between production and first use of the card. When a pin is pressed into pinhole switch 86 on a slave card 82, power from the battery on that card is connected to the circuit on that card. Similarly, the battery power on master card 80 is only connected to the circuit on that card after the reset switch 84 on that card is pressed the first time.

The reset switch 84 on master card 80 is pressed if:

(1) the card is being activated (first press only);

(2) an identification code of a new slave card is being introduced to the identification stack;

(3) an identification code of an existing slave card is being made inactive; or, (4) the alarm is being turned off.

Figure 6:
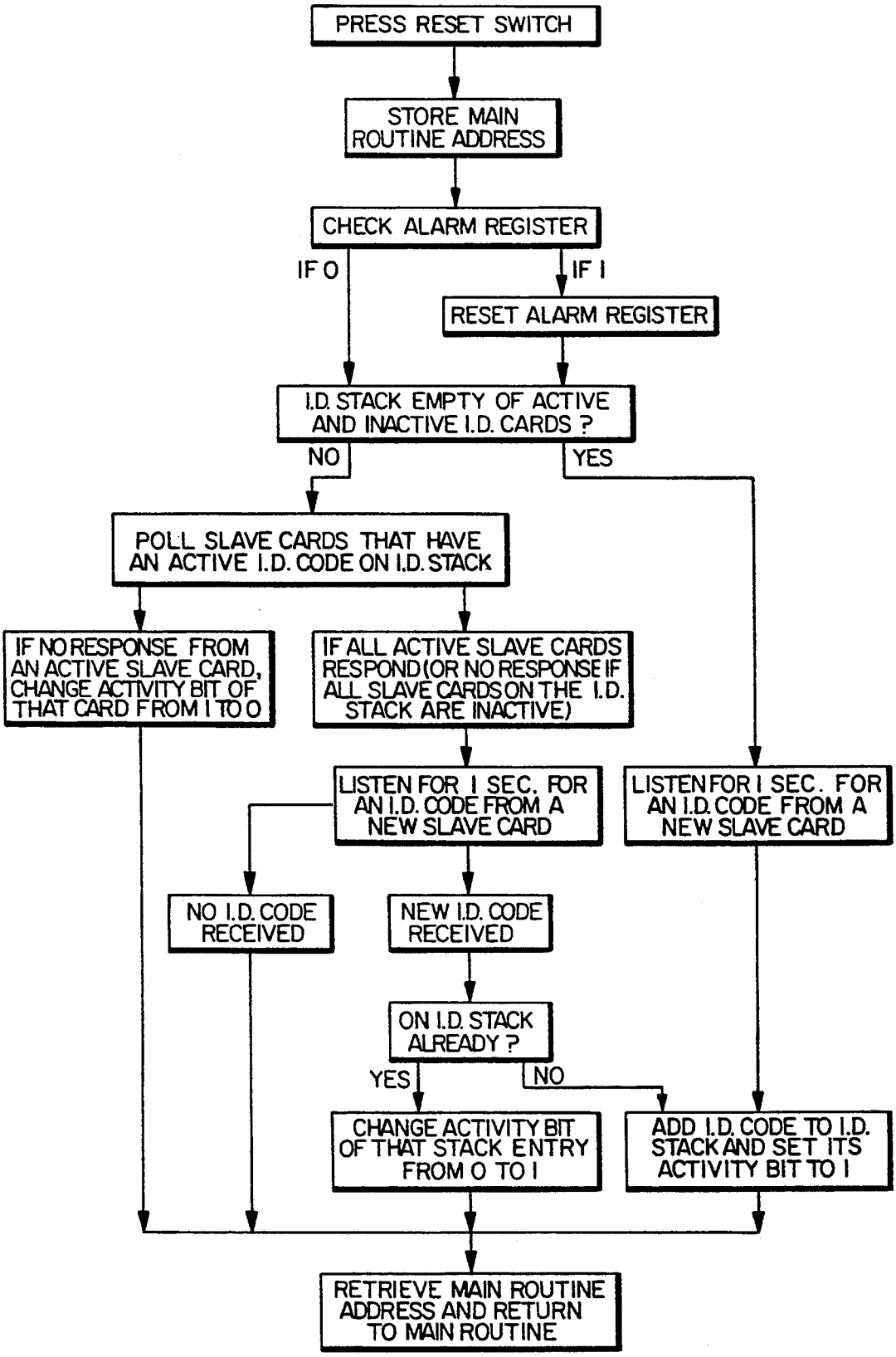
FIG. 6 is a block diagram of an interrupt subroutine on a master card of the third preferred embodiment.
Figure 7:
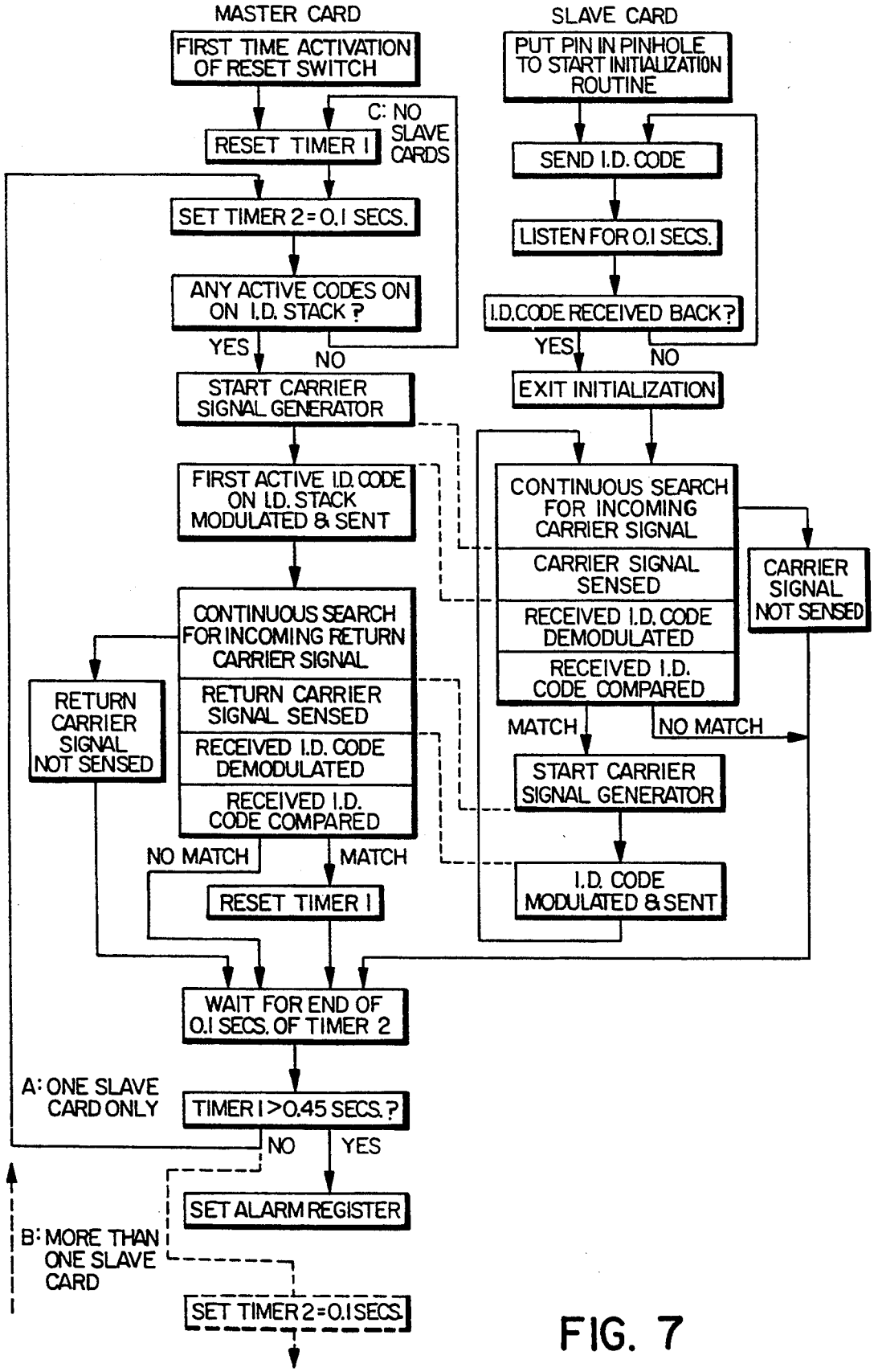
FIG. 7 is a block diagram of the main routine on the master card and the initialization routine and main routine on a slave card of the third preferred embodiment.

A user of this third embodiment of the security system initially receives a master card 80 and one or more slave cards 82, all in an inactive state. The first time reset switch 84 on master card 80 is pressed, the battery on that card is connected to the circuit and the main routine on master card 80 (which, as illustrated in FIG. 7, closely resembles the 'first card' routine of FIG. 2). Each time that reset switch 84 is pressed after the first time, the interrupt subroutine of FIG. 6 is activated.

When reset switch 84 is pressed the first time, there are no slave cards 82 active and the loop marked 'C:NO SLAVE CARDS' in FIG. 7 is entered; the program cycles in that loop until reset switch 84 is pressed again. At this point a user presses a .pin into pinhole 86 on one the slave cards 82. That action starts an initialization routine on the slave card, as shown in FIG. 7. In that routine, the slave card intermittently transmits its identification code and listens during the intervening periods for that code to be retransmitted to it. During this initialization period, the user holds the slave card close to master card 80 and again presses reset switch 84 on that card; that action initiates the interrupt subroutine of FIG. 6. Since the value of the alarm register at this time is 0, it does not need to be reset. Identification code stack register 90 is empty, so the interrupt subroutine listens for 1 second for any new identification code. The subroutine picks up the identification code of activated slave card 82, and places that identification code onto stack register 90, then returns to the master card main routine of FIG. 7. Since an entry now exists on stack register 90, an exit is made from the 'C:NO SLAVE CARDS' path, and the identification code on stack register 90 is transmitted by the main routine. On hearing its identification code, the active slave card 82 leaves its initialization routine and enters its main routine.

For a second slave card 82 to be entered into the security system, a pin is pressed into the pinhole 86 on that card. Then that card is placed close to master card 80, and reset switch 84 is pressed. The interrupt subroutine then polls the first slave card 82, which has an active identification code on identification code stack register 90. If it gets a response from first slave card 82, the interrupt subroutine deduces that the reason for pressing reset switch 84 was not to indicate that the first slave card has been removed from the system, but rather to indicate that a further slave card 82 is being entered into the system. The interrupt subroutine then listens for 1 second for the identification code of the new slave card. The new identification code is added to the existing identification code on stack register 90, and the main routine on master card 80 is then re-entered. With the addition of a second entry on stack register 90, the main routine is lengthened to add the path 'B:MORE THAN ONE SLAVE CARD' in FIG. 7. Further slave cards are entered into the security system in the same way.

If an active slave card is to be removed from the system, it is taken out of the communication range of master card 80. That action sets the alarm register to 1, which activates the alarm circuit. The user then presses reset switch 84. The interrupt subroutine first checks the status of the alarm register; on finding the alarm register to be 1, the subroutine resets the register to 0 which turns off the alarm. Since identification code stack register 90 is not empty, the interrupt subroutine polls the slave cards having active identification codes on that register. No response is received from the slave card that has been moved out of communication range, and the activity bit associated with that card is reset to 0, indicating that the card has become inactive. During the next pass through the main routine of master card 80, the identification code of that inactive slave card is not transmitted; only those identification codes that have an associated activity bit in the set state (1) are transmitted. To re-activate the inactive slave card, that card is brought adjacent master card 80 and the reset switch 84 is pressed. That action causes the activity bit next to the identification code on stack register 90 for that slave card to be changed from the reset state to the set state; the main routine on master card 80 will transmit an identification code to that slave card on its next pass.

Identification code stack register 90 on master card 80 retains the identification codes of all slave cards that have been introduced to it at any time. If a slave card becomes inactive, its identification code is nevertheless retained in the stack register; however, the activity bit associated with that particular identification code is placed into the reset state. The first time that a slave card is introduced to master card 80, the identification code of that slave card is placed onto stack register 90 and the associated activity bit is placed into the set state. This arrangement results in a power saving, since an EEPROM (electrically-erasable programmable memory) is used for the identification code stack register. If the complete identification code of a slave card were to be removed from the stack register each time that the card was removed from the communication range of the master card a larger amount of power would be consumed than if a change is made to a single bit (the 'activity bit') associated with the identification code of that slave card.

Master card 80 may be carried in a similar place on a person as the card 10 of the first embodiment. Each slave card 82 is placed adjacent a valuable object, for instance, one of the slave cards may be activated and placed into a wallet, while another is activated and placed into a briefcase. The master card may be placed into a shirt pocket or other similar location.

Although reference has been made to plastic cards in a form similar to credit cards, it is possible for a plastic card of smaller size to be used. For instance, the electrical components on one of the cards previously described could be incorporated into a tiny piece of plastic wafer which might be fitted into the background of an expensive piece of jewellery. It is intended that the term 'plastic card' in the claims should be read in this broader context.

What is claimed as the invention is:

1. A portable security system comprising a pair of cards adapted for wireless communication with each other, each card being sized sufficiently small as to be capable of being accommodated within a card compartment of a wallet and having a plastic body housing:

(a) a memory holding a digital identification code for identifying the card;

(b) a carrier signal generator;

(c) modulation means for modulating the carrier signal with the identification code in the memory;

(d) an antenna;

(e) a transmitter connected to the antenna for intermittently transmitting the modulated carrier signal to the other card;

(f) a receiver connected to the antenna for intermittently receiving a modulated carrier signal from the other card;

(g) demodulation means for demodulating the carrier signal to obtain a digital code carried in that signal; and, (h) a comparator means for determining if a correspondence exists between the identification code in the memory and the digital code carried in the modulated carrier signal received from the other card; a first one of the cards also housing an alarm means; whereby, within a defined communication range, a modulated carrier signal intermittently transmitted by the first card is adapted to create a correspondence in the comparator means on the other card, whereby on creation of such correspondence the other card is adapted to transmit a return modulated carrier signal to the first card, whereby the return modulated carrier signal is adapted to create a correspondence in the comparator means on the first card, and whereby the alarm means on the first card is actuated if such correspondence is not created in the comparator means on the first card after a defined number of transmissions of the modulated carrier signal by the first card.

2. A portable security system as in claim 1, wherein at least one of the cards is less than 2 millimeters thick.

3. A portable security system as in claim 1, wherein at least one of the cards is less than 2 millimeters thick, less than 60 millimeters high, and less than 90 millimeters wide.

4. A portable security system as in claim 1, wherein the other card is a credit card or a debit card.

5. A portable security system as in claim 1, wherein the defined communication range is approximately three meters.

6. A portable security system as in claim 1, wherein the modulated carrier signal that is transmitted by the first card is transmitted approximately every half second.

7. A portable security system as in claim 1, wherein the defined number of intermittent transmissions is four.

8. A portable security system as in claim 1, wherein a microprocessor performs the functions of the memory, the modulation means, the demodulation means, and the comparator means.

9. A portable security system as in claim 1, wherein the carrier signal has a frequency of 134 kilohertz.

10. A portable security system as in claim 1, wherein the memory holds 32 bits of identification code.

11. A portable security system comprising a series of cards, a first one of the cards adapted for wireless communication with the other cards, each card being sized sufficiently small as to be capable of being accommodated within a card compartment Of a wallet and having a plastic body housing:

(a) a memory holding one or more digital identification codes for identifying the card;

(b) a carrier signal generator;

(c) modulation means for modulating the carrier signal with the one or more identification codes in the memory;

(d) an antenna;

(e) a transmitter connected to the antenna for intermittently transmitting the modulated carrier signal;

(f) a receiver connected to the antenna for intermittently receiving a modulated carrier signal;

(g) demodulation means for demodulating the carrier signal to obtain a digital code carried in that signal; and, (h) a comparator means for determining if a correspondence exists between one of the one or more identification codes in the memory and the digital code carried in the received modulated carrier signal; the first card also housing an alarm means; whereby, within a defined communication range, a modulated carrier signal intermittently transmitted by the first card is adapted to create a correspondence in the comparator means on each of the other cards, whereby on creation of such correspondence on each other card that other card is adapted to transmit a return modulated carrier signal to the first card, whereby each of the return modulated carrier signals is adapted to create a correspondence in the comparator means on the first card, and whereby the alarm means on the first card is actuated if such correspondence is not created in the comparator means on the first card by each of the return modulated carrier signals after a defined number of transmissions of the modulated carrier signal by the first card.

12. A portable security system as in claim 11, wherein at least one of the other cards is less than 2 millimeters thick.

13. A portable security system as in claim 11, wherein at least one of the other cards is less than 2 millimeters thick, less than 60 millimeters high, and less than 90 millimeters wide.

14. A portable security system as in claim 11, wherein at least one of the other cards is a credit card or a debit card.

15. A portable security system as in claim 11, wherein the defined communication range is approximately three meters.

16. A portable security system as in claim 11, wherein the modulated carrier signal that is transmitted by the first one of the cards is transmitted approximately every 0.1 seconds.

17. A portable security system as in claim 11, wherein the defined number of intermittent transmissions is four.

18. A portable security system as in claim 11, wherein a microprocessor performs the functions of the memory, the modulation means, the demodulation means, and the comparator means.

19. A portable security system as in claim 11, wherein the carrier signal has a frequency of 134 kilohertz.

20. A portable security system as in claim 11, wherein each digital identification code is 32 bits long.

21. A portable security system comprising a series of cards, a first one of the cards adapted for wireless communication with the other cards, each card being sized sufficiently small as to be capable of being accommodated within a card compartment of a wallet and having a plastic body housing:

(a) a memory holding one or more digital identification codes for identifying the card;

(b) a carrier signal generator;

(c) modulation means for modulating the carrier signal with the one or more identification codes in the memory;

(d) an antenna;

(e) a transmitter connected to the antenna for intermittently transmitting the modulated carrier signal;

(f) a receiver connected to the antenna for intermittently receiving a modulated carrier signal;

(g) demodulation means for demodulating the carrier signal to obtain a digital code carried in that signal; and, (h) a comparator means for determining if a correspondence exists between one of the one or more identification codes in the memory and the digital code carried in the received modulated carrier signal; the first card also housing an alarm means; each of the other cards also housing an activation switch and not being in communication with the first card until the activation switch on the particular other card is activated, the first card being adapted to be made aware of which of the other cards have been so activated; whereby, within a defined communication range, a modulated carrier signal intermittently transmitted by the first card is adapted to create a correspondence in the comparator means on each of those other cards which are activated, whereby on creation of such correspondence on each of those activated other cards each such activated other card is adapted to transmit a return modulated carrier signal to the first card, whereby each of the return modulated carrier signals is adapted to create a correspondence in the comparator means on the first card, and whereby the alarm means on the first card is actuated if such correspondence is not created in the comparator means on the first card by each of the return modulated carrier signals after a defined number of transmissions of the modulated carrier signal by the first card.

22. A portable security system as in claim 21, wherein at least one of the other cards is less than 2 millimeters thick.

23. A portable security system as in claim 21, wherein at least one of the other cards is less than 2 millimeters thick, less than 60 millimeters high, and less than 90 millimeters wide.

24. A portable security system as in claim 21, wherein at least one of the other cards is a credit card or a debit card.

25. A portable security system as in claim 21, wherein the defined communication range is approximately three meters.

26. A portable security system as in claim 21, wherein the modulated carrier signal that is transmitted by the first one of the cards is transmitted approximately every 0.1 seconds.

27. A portable security system as in claim 21, wherein the defined number of intermittent transmissions is four.

28. A portable security system as in claim 21, wherein a microprocessor performs the functions of the memory, the modulation means, the demodulation means, and the comparator means.

29. A portable security system as in claim 21, wherein the carrier signal has a frequency of 134 kilohertz.

30. A portable security system as in claim 21, wherein each digital identification code is 32 bits long.

* * * * *